US008978694B2

(12) United States Patent
Jang

(10) Patent No.: US 8,978,694 B2
(45) Date of Patent: Mar. 17, 2015

(54) OIL RELIEF VALVE

(71) Applicant: Hyundai Motor Company, Seoul (KR)

(72) Inventor: Sung Kweon Jang, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 57 days.

(21) Appl. No.: 13/739,646

(22) Filed: Jan. 11, 2013

(65) Prior Publication Data

US 2014/0116541 A1 May 1, 2014

(30) Foreign Application Priority Data

Nov. 1, 2012 (KR) ..... 10-2012-0122918

(51) Int. Cl.
*F16K 15/06* (2006.01)
*F01M 1/20* (2006.01)
*F01M 1/16* (2006.01)

(52) U.S. Cl.
CPC .. *F01M 1/20* (2013.01); *F01M 1/16* (2013.01)
USPC .. 137/516.25; 137/538; 137/494; 137/543.17

(58) Field of Classification Search
CPC . F16K 15/25; F16K 17/0446; F16K 17/0433; G05D 16/10
USPC ..... 137/538, 512.5, 535, 540, 528, 543.17, 137/543.19, 543.21, 516.25, 494; 417/310
See application file for complete search history.

(56) References Cited

U.S. PATENT DOCUMENTS 6,352,085 B1 * 3/2002 Morita et al. ..... 137/516.27

FOREIGN PATENT DOCUMENTS

| | | | |
|---|---|---|---|
| JP | 56-10869 | A | 2/1981 |
| JP | 59-197678 | A | 11/1984 |
| JP | 5-332116 | A | 12/1993 |
| JP | 8-100620 | A | 4/1996 |
| JP | 8-158839 | A | 6/1996 |
| JP | 2523574 | Y2 | 10/1996 |
| JP | 2010-216442 | A | 9/2010 |
| KR | 1998-039012 | A | 8/1998 |
| KR | 10-2008-0104886 | A | 12/2008 |

* cited by examiner

*Primary Examiner* — Kevin Lee
*Assistant Examiner* — P. Macade Nichols
(74) *Attorney, Agent, or Firm* — Morgan, Lewis & Bockius LLP

(57) ABSTRACT

An oil relief valve apparatus may include a valve hole that may be formed in a pump housing of an oil pump and may be provided between an oil passage and a relief passage to communicate therebetween, a plunger provided on an upper end of the valve hole, a support provided on a lower end of the valve hole, and an elastic member provided between the plunger and the support to elastically support the plunger, wherein the valve hole has an upper portion and a lower portion and may be provided with the plunger that have different cross sectional areas therein, wherein the plunger has an upper end and a lower end having different cross sectional areas and face-contacts to the valve hole, and wherein the upper end of the plunger may be slidably engaged to the upper portion of the valve hole.

6 Claims, 5 Drawing Sheets

<Realated Art>

OIL RELIEF VALVE

CROSS-REFERENCE TO RELATED APPLICATION

The present application claims priority to Korean Patent Application No. 10-2012-0122918, filed on Nov. 1, 2012, the entire contents of which is incorporated herein for all purposes by this reference.

BACKGROUND OF THE INVENTION

1. Field of the Invention

The present invention relates to an oil relief valve, and more particularly, to an oil relief valve capable of reducing an oil pressure shock, increasing a relief valve opening speed, and reducing an oil pressure trembling phenomenon.

2. Description of Related Art

Generally, a fluid such as oil needs to be supplied to apparatuses such as an engine, a transmission, and the like, of a vehicle at a predetermined pressure. For this purpose, there is a need to drive a pump such as an oil pump. In this case, a pressure of a discharged fluid is changed according to the driving of the pump. The oil pump shows a linear increase in a flux as an engine RPM increases. The increase in a flow rate causes pressure to rise within an engine oil circuit and when an engine pressure is higher than necessary, a problem of oil leakage may occur due to an increase in internal pressure of an oil sealing part and power loss may be increased at the time of the rotation of the oil pump.

In order to prevent the above problems, as illustrated in FIG. 1, an oil pump housing 100 is provided with a relief valve 1. The relief valve 1 includes a plunger 20 that slidably moves vertically in a valve hole 10, a spring 30 that elastically supports the plunger 20, and a support 40 that supports the spring 30. When an oil pressure is above a set pressure, the relief valve 1 interconnects an oil passage 60 with a relief passage 50 to discharge oil through a bypass flow that returns oil to an oil fan again. Therefore, there is a need to appropriately maintain an oil discharge pressure of the oil pump at an appropriate level and prevent damage due to a high pressure. That is, the relief valve 1 is directly received with an oil pressure of oil that is pumped and discharged from the oil pump and when an oil pressure is largely increased, the plunger 20 moves downwardly while the spring 30 is compressed. As the plunger 20 moves downwardly, the oil passage 60 and the relief passage 50 are interconnected with each other such that a part of oil is introduced into the relief passage 50.

According to the relief valve 1 of the related art, the flux of oil that is introduced and returns to the relief passage 50 is linearly controlled by an oil pressure and a spring 30 constant within the relief valve 1. Therefore, as illustrated in FIG. 2, an oil pressure trembling phenomenon excessively occurs on the way to the opening and closing of the oil relief valve 1, such that an operation of the relief valve 1 controlled depending on the oil pressure may be instable and a response speed may be slow until the relief valve 1 becomes a full open state, that is, the operation of the relief valve 1 reaches a normal state. Further, the speed of the relief valve 1 is slow immediately after the relief valve 1 starts to open under the condition that oil viscosity is low, such as cold starting during winter season and thus, a large oil pressure is still generated, causing the oil pressure shock to be large. Therefore, a sealing part may be damaged and power loss may occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an oil relief valve capable of reducing an oil pressure shock, increasing a relief valve opening speed, and reducing an oil pressure trembling phenomenon.

In an aspect of the present invention, an oil relief valve apparatus may include a valve hole that is formed in a pump housing of an oil pump and is provided between an oil passage and a relief passage to communicate therebetween, a plunger provided on an upper end of the valve hole, a support provided on a lower end of the valve hole, and an elastic member provided between the plunger and the support to elastically support the plunger, wherein the valve hole may have an upper portion and a lower portion and is provided with the plunger that may have different cross sectional areas therein, wherein the plunger may have an upper end and a lower end having different cross sectional areas and face-contacts to the valve hole, and wherein the upper end of the plunger is slidably engaged to the upper portion of the valve hole.

By this configuration, the load pressing the elastic member is changed according to the change in a cross sectional area, thereby changing the bypassed amount of oil.

The valve hole may be provided so that the cross sectional area of the upper portion of the valve hole is smaller than that of the lower portion thereof, and the plunger may be provided so that the cross sectional area of the upper end of the plunger is smaller than that of the lower end thereof.

Therefore, the load pressing the elastic member may increase according to the increase in the cross sectional area from the upper end to the lower end, thereby increasing the bypassed oil.

An inclined portion inclined downwardly may be provided between the upper portion and the lower portion of the valve hole.

By this configuration, the flow of oil may be guided to the relief passage.

A height of the upper end of the plunger may be smaller than that between an upper surface of the inclined portion of the valve hole and an upper surface of the relief passage.

The support may be integrally provided with the pump housing to guide the movement of the relief valve.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
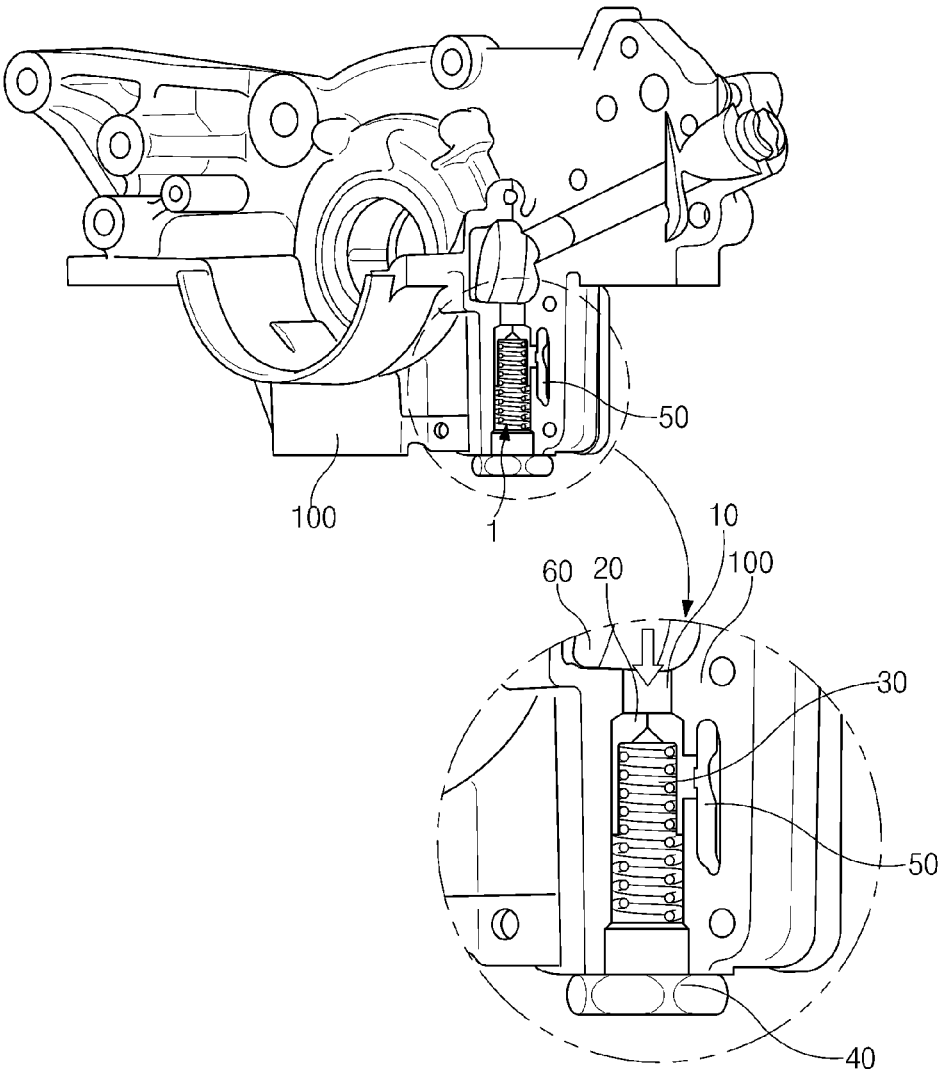
FIG. 1 is a diagram illustrating an oil relief valve according to the related art.
Figure 2:
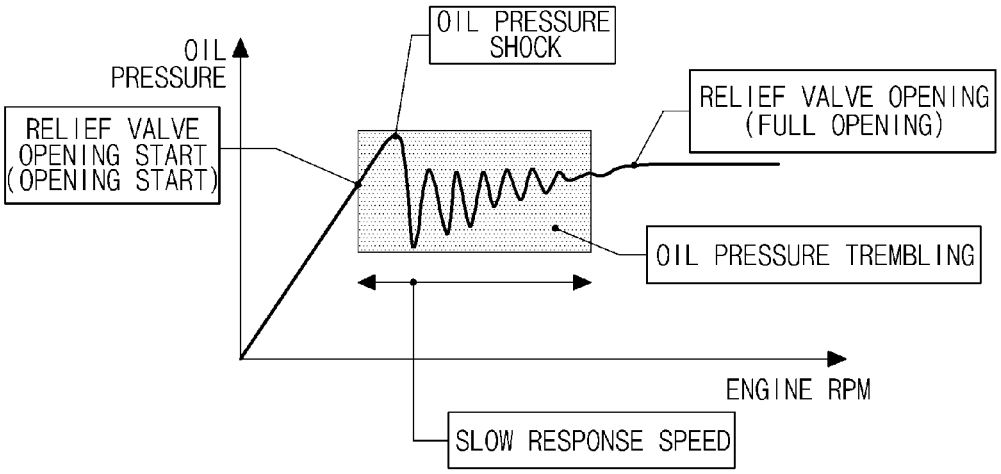
FIG. 2 is a diagram illustrating an oil pressure depending on an engine RPM of the oil relief valve according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3:
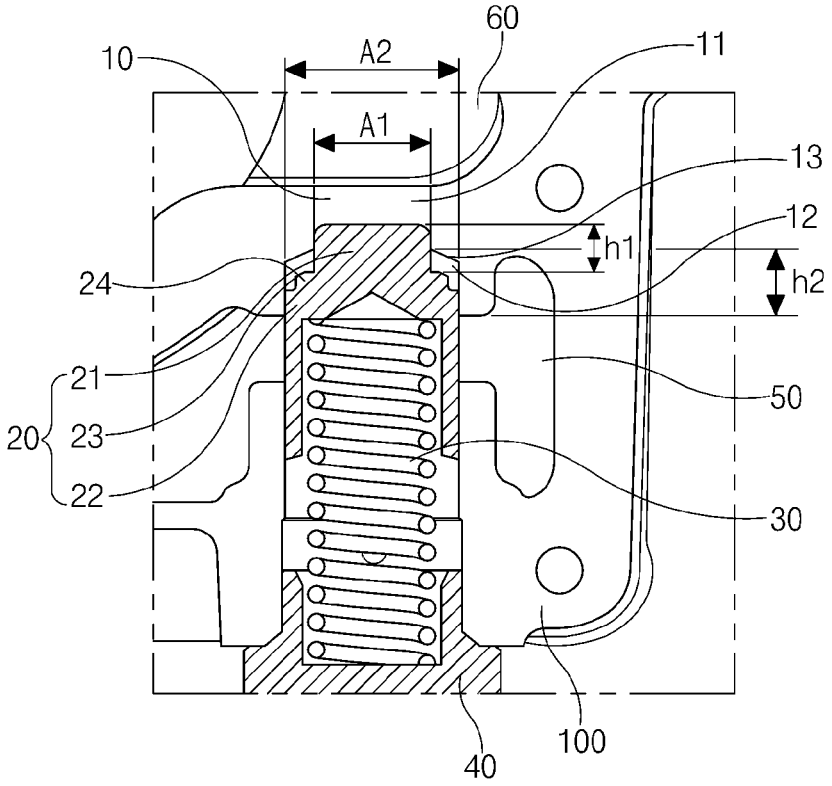
FIG. 3 is a diagram illustrating an oil relief valve according to an exemplary embodiment of the present invention.
Figure 4:
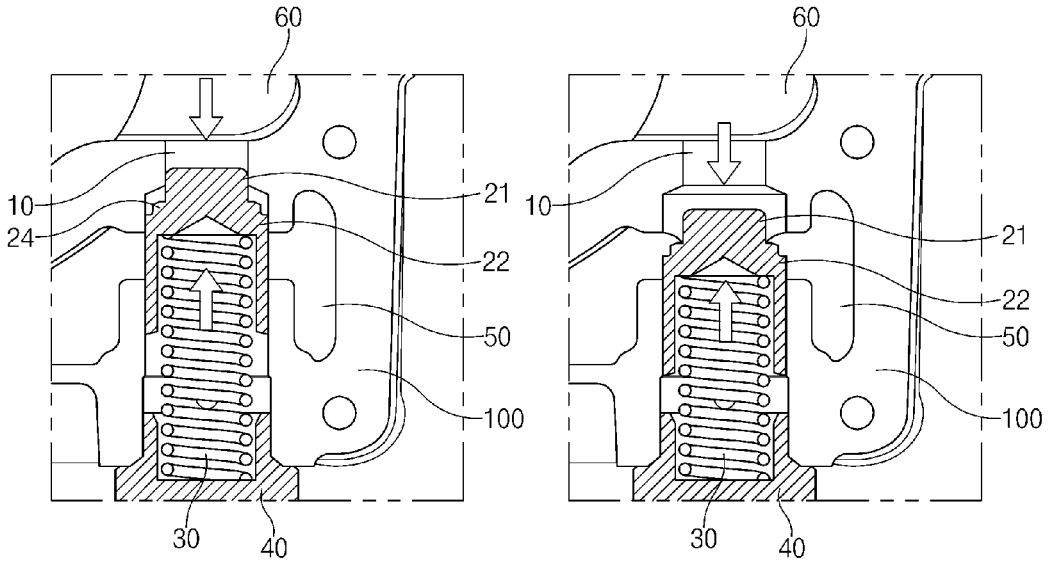
FIG. 4 is a diagram illustrating an operation of the oil relief valve according to the exemplary embodiment of the present invention.
Figure 5:
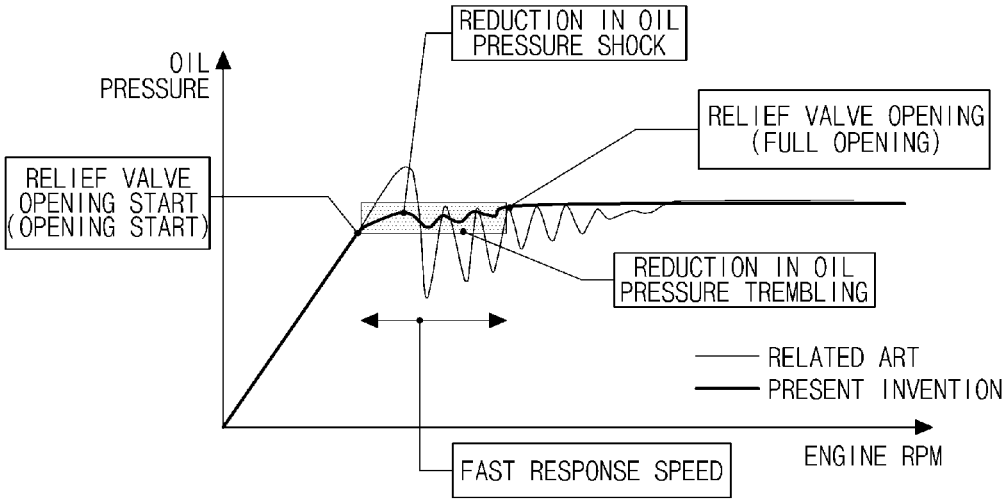
FIG. 5 is a diagram illustrating a comparison of the oil pressure depending on the engine RPM of the oil relief valve according to an exemplary embodiment of the present invention with the related art.

Hereinafter, exemplary embodiments of the present invention will be described with reference to the accompanying drawings. FIG. 3 is a diagram illustrating an oil relief valve according to an exemplary embodiment of the present invention, FIG. 4 is a diagram illustrating an operation of the oil relief valve according to the exemplary embodiment of the present invention, and FIG. 5 is a diagram illustrating a comparison of the oil pressure depending on the engine RPM of the oil relief valve according to an exemplary embodiment of the present invention with the related art, wherein the same parts as the related structure are denoted by the same reference numerals.

As illustrated in FIG. 3, the oil relief valve according to an exemplary embodiment of the present invention includes a relief valve including a valve hole 10 that is formed in a pump housing 100 of an oil pump and is provided between an oil passage 60 and a relief passage 50 to communicate therebetween and a relief valve provided in the valve hole 10. The relief valve includes a plunger 20 that slidably moves vertically in the valve hole 10, a spring 30 that elastically supports the plunger 20, and a support 40 that supports the spring 30.

The valve hole 10 has an upper end on which the plunger 20 of the relief valve is provided and a lower end on which the support 40 of the relief valve is provided. The upper end of the valve hole 10 is provided with an upper portion 11 that is a portion communicating with the oil passage 60 and a lower portion 12 of which one side communicates with the relief passage 50 and extends to a lower end of the valve hole 10, wherein the upper portion 11 and the lower portion 12 are provided to have different cross sectional areas, that is, the cross sectional area of the upper portion 11 is formed to be smaller than that of the lower portion 12. In this configuration, a connection portion of the upper portion 11 and the lower portion 12 is provided with an inclined portion 13 inclined downwardly. Therefore, oil discharged from the oil passage 60 is guided to the relief passage 50.

The plunger 20 is provided on the upper end of the valve hole 10. The plunger 20 is provided with an upper end 21 and a lower end 22, wherein a cross sectional area of the upper end 21 is formed to be smaller than that of the lower end 22. That is, when a vertically projected sectional area of the upper end 21 is referred to as A1 and a vertically projected sectional area of the lower end 22 is referred to as A2, a ratio of A1 to A2 exceeds 1. In this case, the upper end 21 of the plunger 20 face-contacts to the upper portion 11 of the upper portion of the valve hole 10 and the lower end 22 of the plunger 20 face-adheres to the lower portion 12 of the upper portion of the valve hole 10. Further, when the relief valve is in a closed state, the upper end 21 of the plunger 20 is provided over the upper portion 11 and the lower portion 12 of the upper portion of the valve hole 10 and the lower end 22 of the plunger 20 is provided on the lower portion 12 of the upper portion of the valve hole 10 to stop the relief passage 50, such that the closed state of the relief valve is maintained. At least one step 23 having different cross sectional areas may be provided between the upper end 21 and the lower end 22 of the plunger 20.

In an exemplary embodiment of the present invention, step 23 may include a slanted portion 24 and is configured to selectively contact with the inclined portion 13 of the valve hole 10.

The plunger 20 is provided so that a height of the upper end 21 of the plunger 20 is equal to or smaller than a height between an upper surface of the lower portion 12 of the lower end of the valve hole 10 and an upper surface of the relief passage 50. That is, when the upper end 21 of the plunger 20, that is, a height of a portion at which the cross sectional area is A1 is set to be h1 and a starting height of the A2 sectional area of the valve hole 10, that is, a height between the upper surface of the step 13 of the valve hole 10 and the upper surface of the relief passage 50 is set to be h2, a ratio of h1 to h2 is set to be 1 or less. The reason is that when h1 is larger than h2, the lower end 22 of the plunger 20 still stops a relief passage 50 even though the spring 30 is pressed by the introduced oil.

The support 40 is provided on the lower end of the valve hole 10. The support 40 is separately assembled or may be buried in the pump housing 100 or may be integrally provided with the pump housing 100.

The spring 30 is provided between the support 40 and the plunger 20 to elastically support the plunger 20. In this case, the spring elastically supports the plunger 20 upwardly.

An operation and a principle of the oil relief valve according to an exemplary embodiment of the present invention that is provided as described above will be described with reference to FIGS. 4 and 5. For convenience of explanation, a load pressing the spring 30 is set to be F, an oil pressure is set to be P, the cross sectional area of the upper end 21 of the plunger 20 is set to be A1, the cross sectional area of the lower end 22 of the plunger 20 is set to be A2, the spring constant is set to be k, and a displacement of the spring 30 is set to be x.

According to the oil relief valve of the exemplary embodiment of the present invention, the cross section of the plunger 20 is changed from A1 to A2 according to the operation area of the oil pressure at the time when the relief valve starts to open or in the vicinity of the time. Therefore, a force pressing the spring 30 is changed from F=P A1 to F=P A2. Therefore, since A2 is provided to be larger than A1, the force pressing the spring 30 increases as much as A2/A1 times. As the force pressing the spring 30 increases A2/A1 times, the displacement x of the spring 30 also increases A2/A1 times, such that the bypassed flux of oil also increases. That is, the actuation speed of opening the relief valve increases.

Describing in more detail, when the oil pressure is ranging from 0 to 5 bar and above 5 bar in an actuation example, the cross sectional area of the plunger 20 is changed from A1 to A2. Therefore, when the oil pressure P1 in the oil pump is actuated in an area in which the oil pressure is ranging from 0 to 5 bar, a force F1 pushing the relief valve downwardly by a contact surface A1 of the upper end 21 of the plunger 20 vertical to the oil pressure P1 is applied. That is, F1=P1 A1. The spring force applied in the opposite direction becomes kx obtained by multiplying the spring constant k by the displacement x. Therefore, a resultant of force is F1−kx, such that the displacement of the spring 30 is determined and the opening and the closing of the oil relief valve that stops or opens the relief passage 50 by the displacement of the spring 30 are determined. When the oil pressure P1 in the oil pump is actuated in the area in which the oil pressure is above 5 bar, a force F2 pushing the relief valve downwardly by a contact surface A2 of the lower end 22 of the plunger 20 vertical to the oil pressure P is applied. That is, F2=P2 A2. The spring force applied in the opposite direction becomes kx obtained by multiplying the spring constant k by the displacement x. Therefore, a resultant of force is F2−kx, such that the displacement of the spring is determined and the opening and closing of the oil relief valve are determined. That is, when the oil pressure above 5 bar is actuated, the spring displacement x depends on the A2 cross sectional area of the lower end 22 of the plunger 20, such that the opening speed of the relief valve increases. In the present actuation example, the actuation area of the oil pressure is divided into two steps, but the step 23 having different cross sectional areas of the plunger 20 is provided at three stages or more, such that the actuation area of the oil pressure may be more subdivided.

FIG. 5 is a diagram illustrating a comparison of the change in an oil pressure depending on the engine RPM of the oil relief valve according to an exemplary embodiment of the present invention with the related art. As illustrated in FIG. 5, the response speed of the relief valve is faster than the related art until the relief valve is opened and then, becomes the full open state. Further, since the speed of opening the relief valve is fast, the bypassed amount of oil increases, such that the oil pressure shock may be reduced and the oil pressure trembling phenomenon may be improved.

As set forth above, the oil relief valve can change the force pressing the elastic member according to the change in the cross sectional area of the relief valve to increase the bypassed oil amount, thereby reducing the oil pressure shock, increasing the relief valve opening speed, and reducing the oil pressure trembling phenomenon.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil relief valve apparatus, comprising:

a valve hole that is formed in a pump housing of an oil pump and is provided between an oil passage and a relief passage to communicate therebetween;

a plunger provided on an upper end of the valve hole;

a support provided on a lower end of the valve hole; and an elastic member provided between the plunger and the support to elastically support the plunger;

wherein the valve hole has an upper portion and a lower portion and is provided with the plunger that have different cross sectional areas therein;

wherein the plunger has an upper end and a lower end having different cross sectional areas and face-contacts to the valve hole; and wherein the upper end of the plunger is slidably engaged to the upper portion of the valve hole;

wherein the valve hole is provided so that a cross sectional area of the upper portion of the valve hole is smaller than a cross sectional area of the lower portion thereof;

wherein the plunger is provided so that a cross sectional area of the upper end of the plunger is smaller than a cross sectional area of the lower end thereof;

wherein an inclined portion inclined downwardly is provided between the upper portion and the lower portion of the valve hole; and wherein a step is formed between the upper end and the lower end of the plunger and is configured to selectively contact with the inclined portion of the valve hole.

2. The oil relief valve apparatus according to claim 1, wherein the step includes a slanted portion and is configured to selectively contact with the inclined portion of the valve hole.

3. The oil relief valve apparatus according to claim 1, wherein a step is formed between the upper end and the lower end of the plunger.

4. The oil relief valve apparatus according to claim 3, wherein the step includes a slanted portion and is configured to selectively close the lower portion of the valve hole.

5. The oil relief valve apparatus according to claim 1, wherein a height of the upper end of the plunger is smaller than a height between an upper surface of the inclined portion of the valve hole and an upper surface of the relief passage.

6. The oil relief valve apparatus according to claim 1, wherein the support is integrally provided with the pump housing to guide a movement of a relief valve.

* * * * *